US005110308A

United States Patent [19]

Nishikawa et al.

[11] Patent Number: 5,110,308

[45] Date of Patent: May 5, 1992

[54] CONNECTOR

[75] Inventors: Toshio Nishikawa; Yuichi Maruyama; Hiromi Ogura; Kenshi Michishita, all of Nagaokakyo, Japan

[73] Assignee: Murata Manufacturing Co., Ltd., Kyoto, Japan

[21] Appl. No.: 567,011

[22] Filed: Aug. 13, 1990

[30] Foreign Application Priority Data

| | | | |
|---|---|---|---|
| Aug. 11, 1989 | [JP] | Japan | 1-95024[U] |
| Aug. 11, 1989 | [JP] | Japan | 1-95025[U] |
| Feb. 28, 1990 | [JP] | Japan | 2-20659[U] |
| Feb. 28, 1990 | [JP] | Japan | 2-20660[U] |

[51] Int. Cl.[5] ..... H01R 17/18

[52] U.S. Cl. ..... 439/582; 439/585

[58] Field of Search ..... 439/578, 582, 585, 98, 439/99, 881, 882, 579, 580, 581

[56] References Cited

U.S. PATENT DOCUMENTS

| | | | |
|---|---|---|---|
| 3,281,756 | 10/1966 | O'Keefe et al. | 439/99 |
| 3,646,502 | 2/1972 | Hutter et al. | 439/99 |
| 3,699,504 | 10/1972 | Huber | 439/585 |
| 4,269,469 | 5/1981 | Audic | 439/585 |
| 4,453,796 | 6/1984 | Monroe | 439/582 |
| 4,619,496 | 10/1986 | Forney, Jr. et al. | 439/585 |
| 4,655,534 | 4/1987 | Stursa | 439/582 |
| 4,678,261 | 7/1987 | Mitani et al. | 439/582 |
| 4,881,912 | 11/1989 | Thommen et al. | 439/585 |
| 4,932,898 | 6/1990 | Goodman et al. | 439/582 |
| 4,990,105 | 2/1991 | Karlovich | 439/578 |

FOREIGN PATENT DOCUMENTS

| | | | |
|---|---|---|---|
| 0311740 | 4/1989 | European Pat. Off. . | |
| 1665624 | 5/1974 | Fed. Rep. of Germany . | |
| 1541409 | 10/1968 | France | 439/582 |
| 275351 | 1/1990 | German Democratic Rep. . | |

*Primary Examiner*—David L. Pirlot
*Assistant Examiner*—Kevin J. Carroll
*Attorney, Agent, or Firm*—Wenderoth, Lind & Ponack

[57] ABSTRACT

A connector is disclosed which is to be mounted to a coaxial cable having an internal conductor, an internal insulator, cable outer (or shield) conductor, and a cable outer insulator. The connector comprises a housing formed of a connector outer conductor and a concentric inner contact. The connector outer conductor includes a cylindrical main portion and a rear cover portion. An outer conductor adapter is fixed to the main portion of the connector outer conductor and is adapted for insertion between the internal insulator and the cable outer conductor of the coaxial cable. A sleeve portion, which can include either a single securing member or two securing members to be wrapped about the coaxial cable, is formed integrally with the connector outer conductor. The inner contact is provided at its rear end with a slot into which the internal conductor is to be thrust, and at its forward end with a plurality of slits to provide an elastic firm holding force for holding a mating contact of another cable. An insulating member can be provided on a rear end of the inner contact. The insulating member is frustoconically shaped and includes a tapered groove in its front face to squeeze the rear end of the inner contact so as to positively engage the internal conductor in the slot. Solder can be provided about the internal conductor for more positive contact.

34 Claims, 13 Drawing Sheets

CONNECTOR

BACKGROUND OF THE INVENTION

The present invention generally relates to a connector, and more particularly, to improvements in a connector for mounting a cable.

Conventionally, such connectors as shown in, for example, FIG. 26 and FIG. 27 are used as connectors to be mounted on the cable. Referring to the drawings, an inner contact 104 from a connector outer conductor 102 with an insulating bushing 103 is inserted into the connector outer conductor 102 of a cut and assembled housing 101. An outer conductor adapter 107 which is adapted to be connected with a cable outer (or shield) conductor 106 of a cable 105 is mounted on the connector outer conductor 102. The connector is extended into the cable 105 prior to the connection between the connector and the cable 105, and has a sleeve 112 which fixedly attaches under pressure the cable outer conductor 106 against the outer conductor adapter 107 in the connecting step.

In order to mount the cable 105 on the connector, as illustrated in FIG. 27, first, an internal conductor 108 and an internal insulator 109 extending from the cable insulator 110 of the cable 105 are inserted into the outer conductor adapter 107 of the connector. The internal conductor 108 is inserted into the slit 104*a* of the inner contact 104 so as to solder the internal conductor 108 and the inner contact 104 for the connecting operation thereof. Thereafter, a cover 111 is put on. The outer conductor adapter 107 is covered with the cable outer conductor 106, the sleeve 112 is moved onto the cable outer conductor 106. The cable outer conductor 106 is caused to adhere under pressure against the outer conductor adapter 107 by the securing operation of the sleeve 112.

But the conventional connector had disadvantages in that it was necessary to cut and prepare the housing, the outer conductor adapter and so on. Thus, the manufacturing step was complicated and the sleeve 112 had to be manufactured and prepared as a separate part, thereby resulting in higher costs. Also, another disadvantage is that the sleeve had to be mounted about the cable in advance, such that the step in mounting the connector on the cable was complicated, and the standard assembly time was relatively long.

SUMMARY OF THE INVENTION

Accordingly, the present invention has been developed with a view to substantially eliminating the above discussed drawbacks inherent in the conventional connector and has for its essential object to provide an improved connector.

Another important object of the present invention is to provide an improved connector of the type referred to above, which has a lower cost, and is capable of being assembled in a shorter time.

Still another object is to provide a connector which is capable of positive connection between the socket (or inner contact) and the cable conductor without the necessity of a soldering operation, and a connector which is capable of corresponding to the smaller size thereof.

A further object is to provide a coaxial connector, wherein short-circuiting that is caused by contact between a cable central conductor and a connector outer conductor is prevented, the insulator may be easily engaged with the connector outer conductor, the above described insulating plate is difficult to disengage during use after the engagement thereof, and the slit of the connector central conductor is prevented from expanding even upon pressure insertion of the cable central conductor therein.

A still further object is to provide a connecting construction between the coaxial connector and the coaxial cable, wherein easier mechanization may be effected, so that the assembly time may be shortened, and also, the costs may be reduced, the quality may be stabilized, and furthermore, the electrical connection may be stabilized.

In accomplishing these and other objects, according to one preferred embodiment of the present invention, there is provided a connector which includes a housing that is provided integrally with a connector outer conductor to be connected through an outer conductor adapter with at least an outer conductor of a cable, and a sleeve portion that causes the outer conductor of the above described cable to adhere under pressure on the above described outer conductor adapter, and also combines the cable with the connector. An inner contact, insulated from the connector outer conductor, is provided on the inner side of the above described connector outer conductor, and is connected with the internal conductor of the cable.

The above described sleeve portion may be provided with a first securing member which causes the cable outer conductor of the above described cable to fixedly adhere under pressure on the above described outer conductor adapter, and a second securing member which retains the insulator of the cable so as to further secure the cable.

In the connector of the invention constructed as described hereinabove, the housing provided integrally with the connector outer conductor portion and the sleeve portion eliminates the necessity of manufacturing and assembling the sleeve for pressure adherence in the conventional connector as a separate part, to thereby simplify the manufacturing step of the connector. This also deletes the step which is indispensable in the conventional connector of mounting the sleeve about the cable in advance, and thereby simplifies the mounting step of the connector onto the cable.

Also, the connector of the present invention is characterized in that at least one cable side slit, which is narrower in width than the inner conductor of a cable to be thrust thereinto, is provided on the side, to be connected with the inner conductor of the cable, of a cylindrical socket. The above described inner conductor is thrust into the slit in the above described conductor into pressure contact with each other to effect electrical and mechanical connection therebetween.

Further, the connector of the present invention is characterized in that at least one cable side slit, which is narrower in width than the conductor of the cable to be thrust thereinto, is approximately parallel to the central axis of the above described socket, and at least one other connector side slit is provided and is substantially normal to (i.e. formed circumferentially about the assembled inner contact) the above described cable side slit, on the side of the socket for connecting with the contact of the other connector.

In the connector constructed as described hereinabove, the cable side slit which is narrower in width than the conductor of the cable formed in the socket of the connector, depresses and grasps the conductor of the cable to be thrust thereinto so as to firmly connect the socket with the cable of the conductor both electrically and mechanically.

Also, in the above described connector, the connector side slit of the socket is formed and disposed so that the connector side slit of the socket may not be positioned on an extension line extending in the slitting direction thereof from the cable side slit (i.e. it is normal thereto). The mechanical strength of the socket is larger and the portion grasped by the cable side slit of the plate shaped member composing the socket and the connector side slit becomes narrower in width so as to lessen the reduction in the mechanical strength of that portion. If the socket is made smaller in size, the force, for retaining the inner conductor of the cable and the contact of the other connector so as to provide the positive connection among the socket and the inner cable conductor and the contact of the other connector, is not reduced.

In order to achieve the above described objects, the coaxial connector of the present invention has a central conductor fixed through an insulator and an insulating plate to the outer conductor. The connector is characterized in that the above described insulating plate to be put on the root portion of the above described central conductor is molded together with other such insulating plates on a hoop element. The outer peripheral face of the insulating plate is formed with an upwardly and outwardly tapered shape, and includes a groove in a bottom face thereof into which the above described central conductor is inserted. The groove is formed with a shape tapered in the opposite direction as the taper of the outer periphery of the plate. Also, the length of the above described groove is set to correspond to the gap formed between the tip end face portion of the above described groove and the above described central conductor.

According to the above described construction, in the coaxial connector with the central conductor being secured through the insulator and the insulating plate to the outer conductor, the insulating plate to be put on the root portion of the connector central conductor is formed by continuous strip molding on hoop-type strips so that the pitch adjusting may be easily effected even in a multiple string assembly in the mounting of the above described insulating plate on the above described central conductor. The outer peripheral face of the above described insulating plate is formed with an upwardly and outwardly tapered shape, thus simplifying the operation of inserting the above described insulating plate into the above described outer conductor. Also, a groove into which the above described connector central conductor is inserted is formed in the central portion of the above described insulating plate, and the groove is formed with a tapered shaped reverse to the above described taper so that the cable central (or inner) conductor received in the slit of the above described connection central conductor is clamped therein when the insulating plate is secured in the end of the outer conductor. Further, the length of the groove is set so that a gap may be formed between the tip end face portion of the groove of the above described insulating plate and the above described connection central conductor so that excess cable central conductor length is accommodated within the groove.

Further, in order to achieve the above described object, in the connecting construction between the coaxial connector and the coaxial cable in the present invention, a slit which is narrower in width than the diameter of the cable central conductor is formed in the tip end portion of the connection central conductor which is to be formed into a cylindrical shape. Also, auxiliary soldering is effected on the above described cable central conductor.

According to the above described construction, as the slit which is narrower in width than the diameter of the cable central conductor is formed in the tip end of the portion of the connector central conductor to be formed into the cylindrical shape, the above described cable central conductor is inserted under pressure into the slit so as to effect the connection between them. Accordingly, the soldering operation in the small portions becomes unnecessary, thus allowing mechanization and reduction in the assembly time, as well as reduced costs and reliable quality. As the auxiliary solder is applied upon the above described cable central conductor, the cable central conductor is prevented from oxidizing, and increase in the contact resistance is prevented, thus making it possible to provide reliable electrical connections.

BRIEF DESCRIPTION OF THE DRAWINGS

These and other objects and features of the present invention will become apparent from the following description taken in conjunction with the preferred embodiment thereof with reference to the accompanying drawings, in which:

FIG. 16 (*b*) is a sectional view taken along a line A—A in FIG. 16 (*a*);

FIG. 17 (*b*) is a sectional view taken along a line B—B in FIG. 17 (*a*);

FIG. 18 (*b*) is a bottom face view showing the insulating plate;

FIG. 18 (*c*) is a sectional view taken along a line C—C in the FIG. 18 (*b*);

FIG. 19 (*b*) is a partial enlarged view of the insulating plate in FIG. 19 (*a*);

FIG. 20 (*b*) is a partial enlarged view of the insulating plate in FIG. 20 (*a*);

FIG. 24 is a front face view showing a condition before the cable central conductor is inserted under pressure into the slit of the connector central conductor;

FIG. 25 (*b*) is a front face view showing a condition after the cable central conductor has been inserted under pressure into the slit of the connector central conductor.

DETAILED DESCRIPTION OF THE INVENTION

Figure 1:
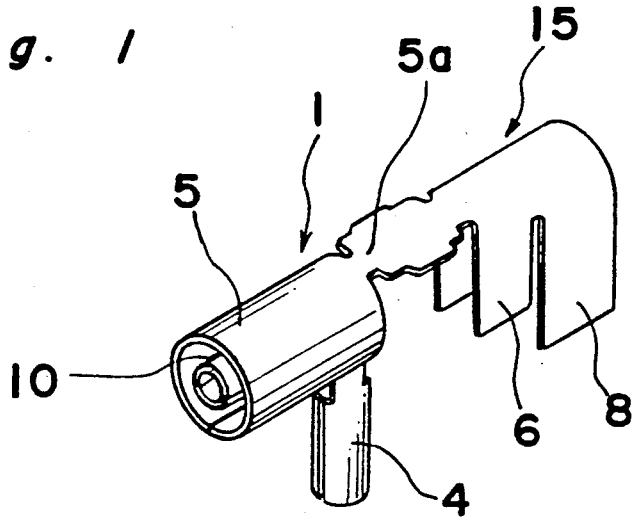
FIG. 1 is a perspective view showing a housing of a connector in accordance with a first embodiment of the present invention.

Before the description of the present invention proceeds, it is to be noted that like parts are designated by like reference numerals throughout the accompanying drawings.

Referring now to the drawings, there is shown in FIG. 1 through FIG. 6 a first embodiment of the present invention.

First Embodiment

Figure 2:
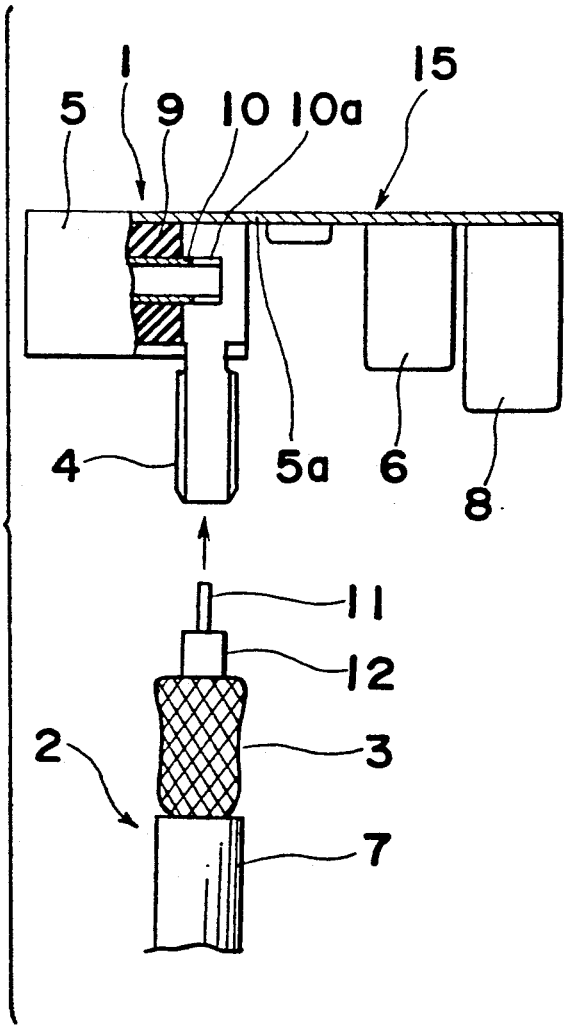
FIG. 2 and FIG. 3 are partial sectional views for illustrating the first embodiment of the present invention.
Figure 3:
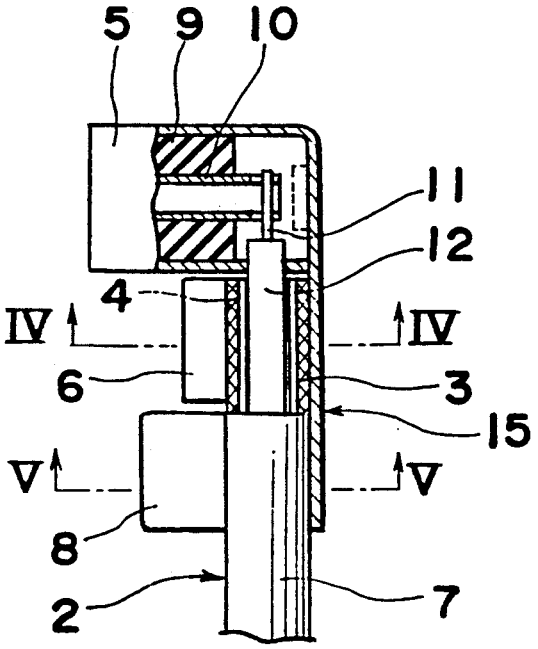

FIG. 1 shows a perspective view of a connector in a first embodiment of the present invention. FIG. 2 and FIG. 3 show steps in the operation of mounting the connector on the cable. The housing 1 of the connector is provided integrally with a connector outer conductor to be electrically connected through the outer conductor adapter 4 of the connector with the cable outer conductor (or shield conductor) 3 of the coaxial cable 2, and a sleeve portion 15. The connector outer conductor includes a main portion and a rear cover portion 5*a*. The housing 1 is integrally molded through the press treating of a plate shaped member composed of a good conductor. The sleeve portion 15 is provided with a first securing member 6 which causes the cable outer conductor 3 of the coaxial cable to fixedly adhere under pressure against the above described outer conductor adapter 4, and a second securing member 8 which further retains the cable outer insulator 7 of the coaxial cable 2 so as to strengthen the attachment of the connector with the coaxial cable 2. The first and second securing members are separated by slots. An inner contact 10 which is to be connected with the internal conductor 11 of the coaxial cable 2 is disposed within the main portion 5 of the connector outer conductor. The inner contact 10 is insulated from the main portion 5 of the connector outer conductor by an insulating bushing 9. The outer conductor adapter 4, which is adapted to connect the main portion 5 of the connector outer conductor with the cable outer conductor 3 of the coaxial cable 2, is molded integrally, as one-piece, with the main portion 5 of the connector outer conductor in the embodiment to simplify manufacturing of the connector. The adapter is manufactured in a shape necessary to make it possible to mount it on the main portion 5 of the connector outer conductor.

Figure 4A:
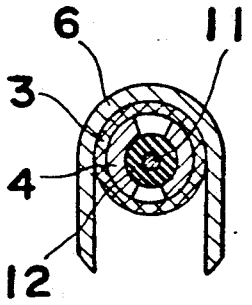
FIG. 4*a* and FIG. 4*b* are respectively sectional views taken along a line of IV—IV of FIG. 3 in two different stages of assembly.
Figure 4B:
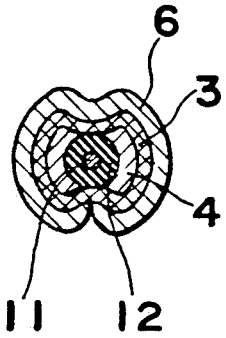
Figure 5A:
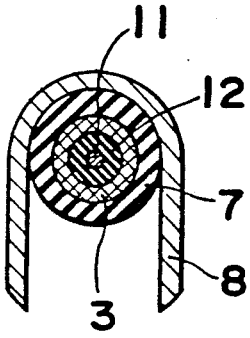
FIG. 5*a* and FIG. 5*b* are respectively sectional views taken along a line V—V of FIG. 3 in two different stages of assembly.
Figure 5B:
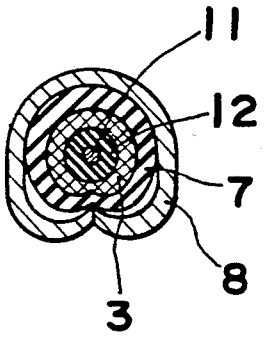

A step in the mounting of the connector having the above described construction onto the coaxial cable 2 will be described hereinafter in accordance with FIG. 2 through FIG. 5*b*. First, the internal conductor 11 of the coaxial cable 2 and the internal cable insulator 12 for insulating the internal conductor 11 from the cable outer conductor 3 are inserted into the cylindrical outer conductor adapter 4. At this time, the outer conductor adapter 4 is inserted between the internal insulator 12 of the coaxial cable 2 and the cable outer conductor 3. Then the internal conductor 11 is connected with the inner contact 10, in this embodiment, the inner contact 10 is cylindrical and is provided in its tip end portion with a slit 10*a* into which the internal conductor 11 is inserted. The internal conductor 11 is thrust into the slit 10*a* such that it is grasped therein and the internal conductor 11 is connected to the inner contact 10. Then, after the sleeve portion 15 formed continuously with the rear cover portion 5*a* of the connector outer conductor has been moved into operative position (FIG. 3) by bending at an angle of approximately 90 degrees at the boundary between the main portion 5 and the rear cover portion 5*a*, the first securing member 6 is wound about the cable outer conductor 3 so as to cause the cable outer conductor 3 to adhere under pressure against the outer conductor adapter 4. At the same time, the second securing member 8 is wound about the cable outer insulator 7 to secure it to positively connect the connector with the coaxial cable 2. FIG. 4*a* is a sectional view showing a condition before the first securing member 6 is secured, and FIG. 4*b* is a sectional view after it has been secured. FIG. 5*a* is a sectional view showing a condition before the second securing member 8 is secured, and FIG. 5*b* is a sectional view showing a condition after it has been secured.

Figure 6:
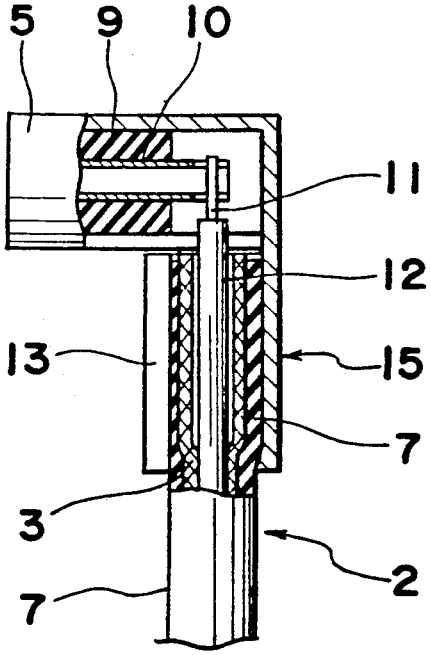
FIG. 6 is a partial sectional view showing another embodiment of the present invention.

As described in FIG. 6, the sleeve portion 15 can be formed as a single securing member 13, secured integrally about the cable outer insulator 7, so that it is possible to achieve the combination between the coaxial cable 2 and the connector at the same time as when the cable outer conductor 3 is caused to adhere under pressure on the outer conductor adapter 4.

In the above described embodiment, although an L-shaped coaxial connector is shown, the connector of the present invention is not limited to either an L-shaped connector or for use with coaxial cable, but may be applied to connectors of various types, and even to connectors for multiple core cable.

As described hereinabove, since the connector of the first embodiment has the connector outer conductor formed integrally with the sleeve portion, the manufacturing cost may be reduced by the simplification of the manufacturing steps. Also, in the conventional connector, a step of mounting a sleeve about the cable in advance for adhering the connector to the cable was indispensable, but has been rendered unnecessary by the present invention, with the effect that the time required for cable assembly may be reduced.

The connector which causes the cable outer conductor to adhere under pressure against and connect with the outer conductor adapter by use of the first securing member, retains the outer insulator of the cable by use of the second securing member so as to strengthen the attachment of the connection to the cable, and provide a more reliable positive electrical and mechanical connection between the cable and the connector.

Second Embodiment

Figure 7:
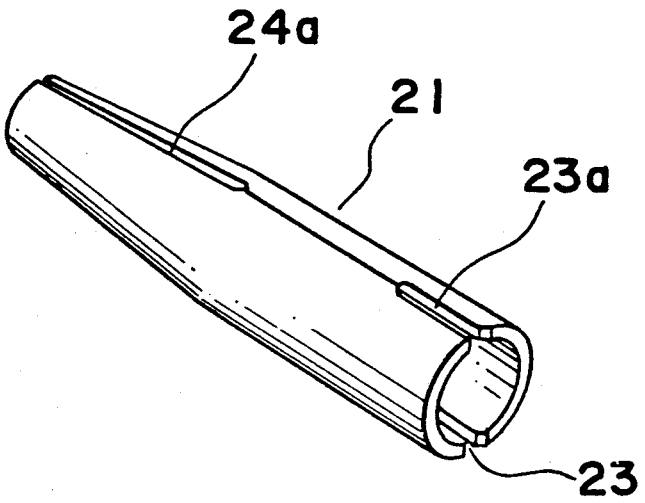
FIG. 7 is a perspective view showing a socket of the connector in a second embodiment of the invention.
Figure 8:
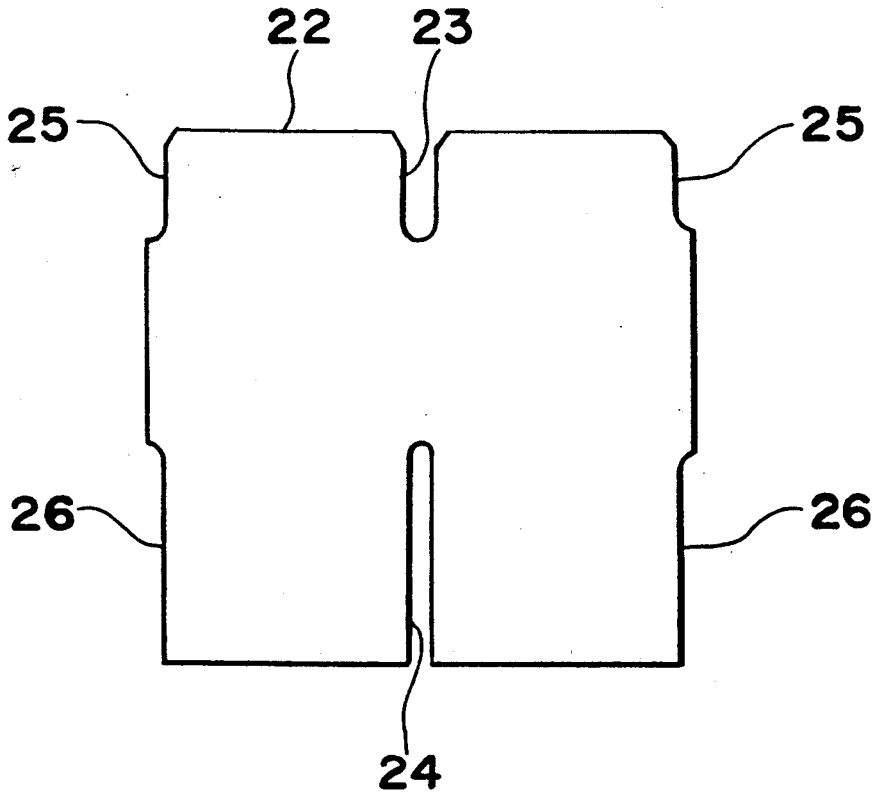
FIG. 8 is an expansion view of a socket of FIG. 7.
Figure 9:
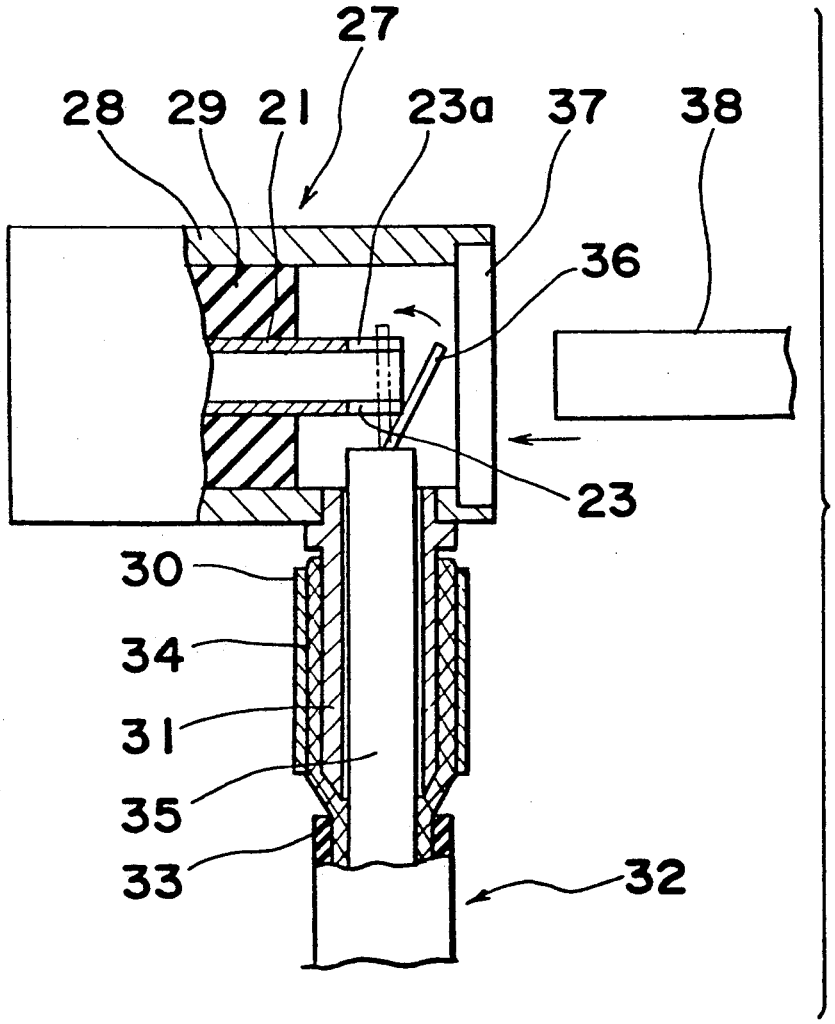
FIG. 9 is a partial sectional view of the invention.
Figure 10A:
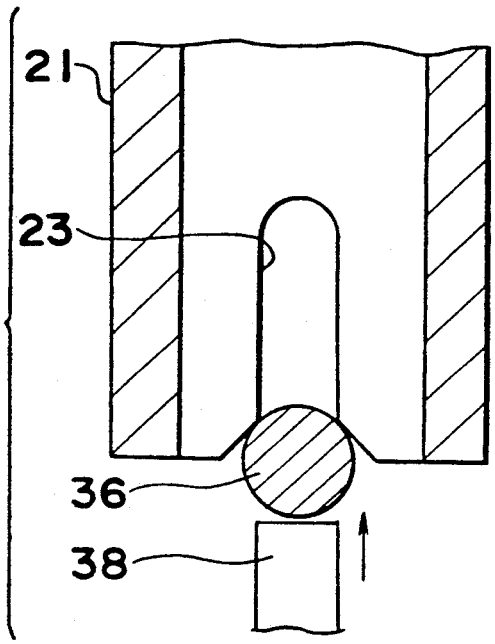
FIG. 10*a* and FIG. 10*b* are a plan sectional view and a front face view showing a condition before an inner conductor of a cable is thrust into the slit of the socket.
Figure 10B:
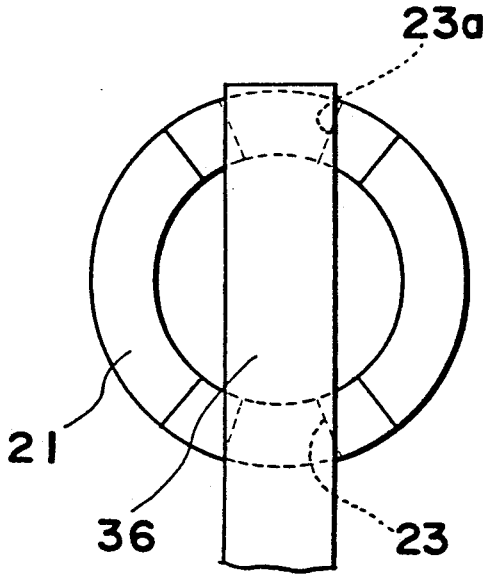
Figure 11A:
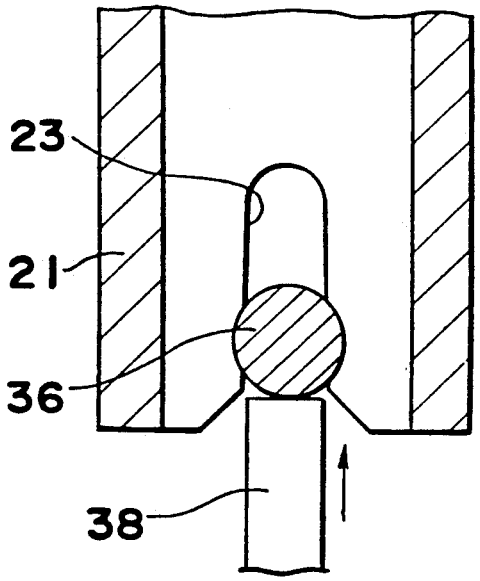
FIG. 11*a* and FIG. 11*b* are a plan sectional view and a front face view showing a condition after the inner conductor has been thrust into the slit of the socket.
Figure 11B:
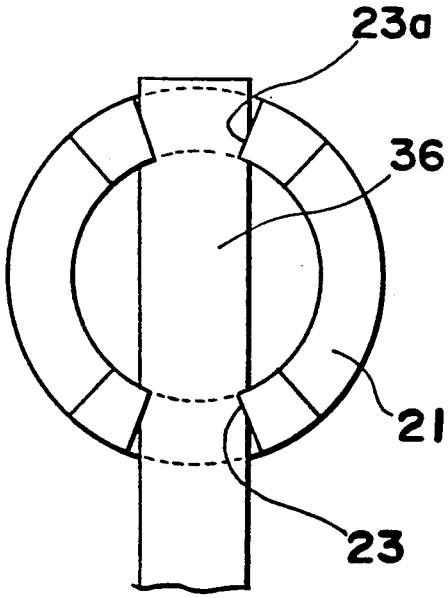

A second embodiment of the present invention will be described hereinafter with reference to FIG. 7 through FIG. 15. FIG. 7 is a perspective view showing a socket portion of a connector in accordance with the present invention. FIG. 8 is a view showing an expanded condition of a plate shaped member which is to be formed into a socket. As shown, the socket 21 in the embodiment is composed of a plate shaped member 22 composed of a good conductor which is press-treated into the given shape and then wound into a cylindrical shape. Namely, a cable side slit, which is narrower in width than the diameter of the central (or inner) conductor 36 and into which the central conductor 36 (e.g. see FIG. 3) of the cable is to be thrust, is formed on the upper side of the plate shaped member 2 of FIG. 8. Furthermore, a connector side slit 24 is formed on the lower piece so that a mating contact C of a cable adapted to be connected to the coaxial cable may be retained firmly by the elastic force of the plate shaped member 22 by the engagement with the mating contact C (see FIG. 14) of the other connector. Further, the cable side notches 25, 25 and the connector side notches 26, 26 are formed on both the right and left sides of the plate shaped member 22, such that when the plate shaped member 22 is formed into the cylindrical shape another cable side slit 23*a* and a connector side slit 24*a* are respectively formed. Connection of the conductor of the cable to the connector having the above described socket 21 which is insulated from the connector outer conductor 28 is inserted, along with the insulating bushing 29, into the connector outer conductor 28 of the housing 27. An outer conductor adapter 31 connecting the connector outer conductor 28 with the outer conductor 34 of the cable 32 is mounted on the connector outer conductor 28. The central conductor 36 of the coaxial cable 32 extending from the cable outer insulator 33, and the internal insulator 35 are inserted into the outer conductor adapter 31. Also, the cable outer conductor 34 adheres under pressure onto the outer periphery of the outer conductor adapter 31 with the sleeve 30. Then, a depressing jig 38 is inserted through the opening portion 37 of the housing 27, and the central conductor 36 is thrust into the cable side slits 23, 23*a* of the socket 21. Thereafter, the depressing jig 38 is withdrawn and the cover (not shown) is placed on the opening portion 37. The central conductor 36 is inserted under pressure into the slits 23, 23*a* of the socket 21 in this manner so as to connect the socket 21 with the central conductor 36 electrically and mechanically. The condition before the central conductor 36 is thrust into the slits 23, 23*a* of the socket 21 is shown in FIG. 10*a* and FIG. 10*b*, while the condition after it has been thrust thereinto is shown in FIG. 11*a* and 11*b*. The connector having the above described construction makes it possible to effect a quick and positive connection of the central condition 36 to the socket 21 without soldering. A stable connection may be maintained as the solder is not melted even at high temperatures.

Although a connector for single core coaxial cable use is shown in the above described embodiment, the connector in the present invention is not restricted to the connection of single core cable as described hereinabove, and may be applied even to the connection of multiple core cable to a multiple core connector.

Figure 12:
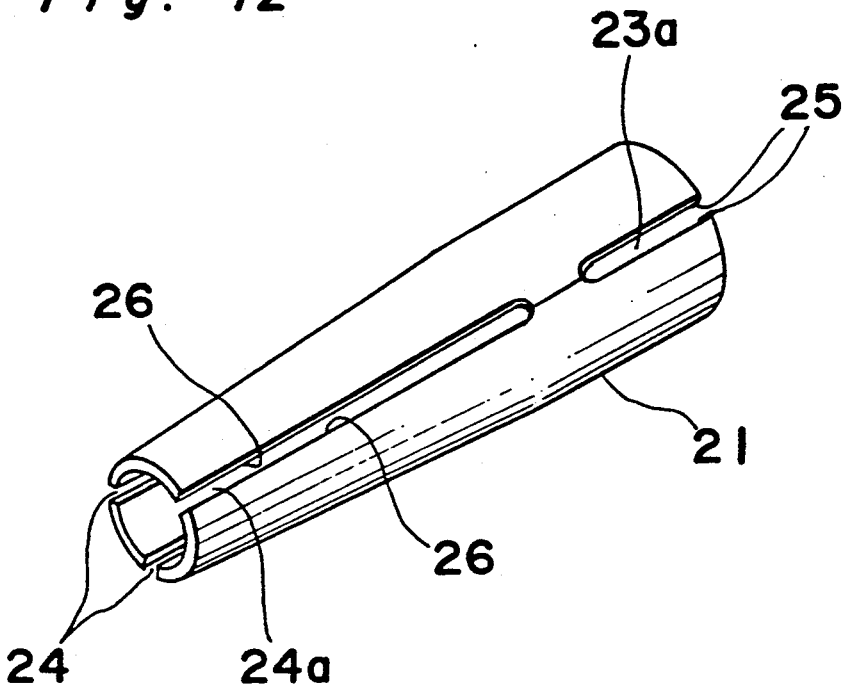
FIG. 12 is a perspective view showing a socket of a connector showing a modification of the second embodiment of the invention.
Figure 13:
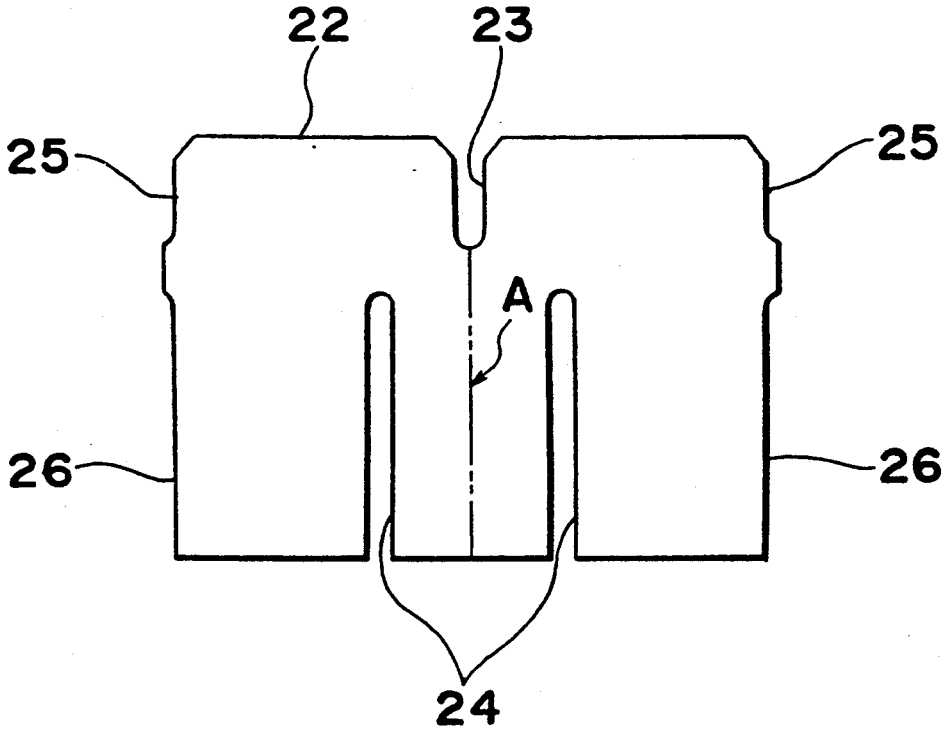
FIG. 13 is an expansion view of a socket of FIG. 12.
Figure 14:
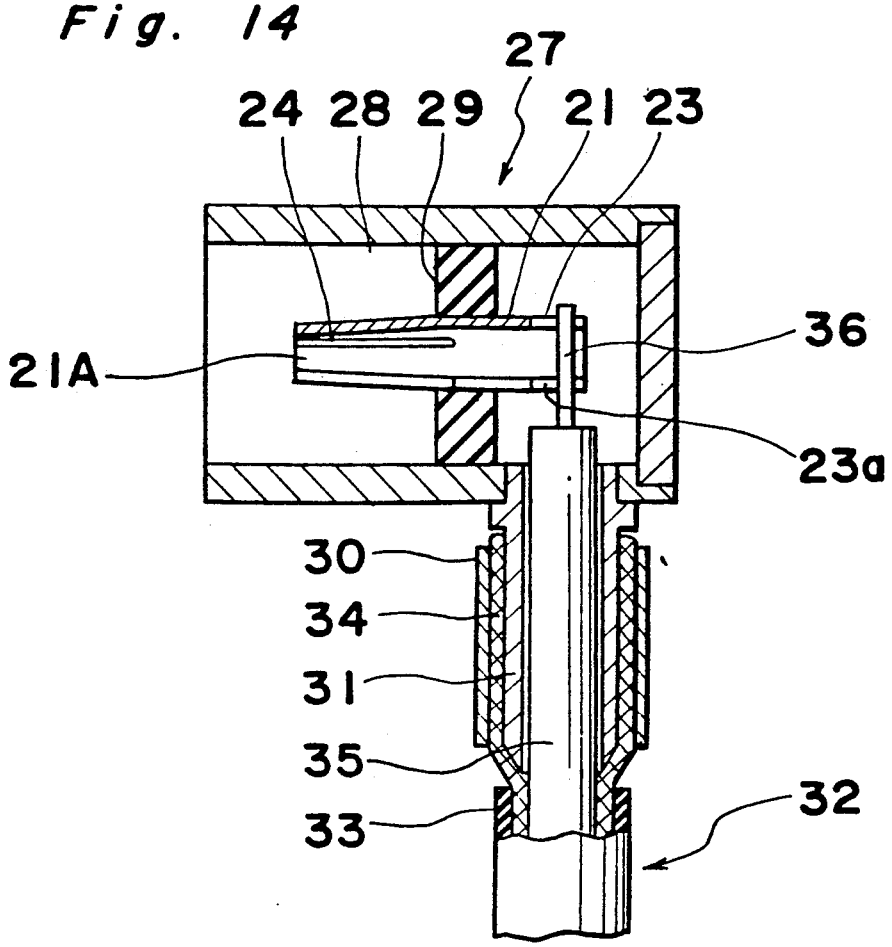
FIG. 14 is a sectional view showing a connector having a socket as shown in FIG. 6.

A modified embodiment of the connector in the second embodiment will be described hereinafter. FIG. 12 is a perspective view showing the socket portion of the connector in the modified embodiment of the present invention. FIG. 13 is a view showing an expanded condition of a plate shaped member used to form the socket. FIG. 14 shows a connector provided with the socket of FIG. 12. As shown in the drawing, the socket 21 in the embodiment is provided at approximately the center of the upper side of the plate shaped member 22 with a cable side slit 23 into which the central conductor of the cable is to be thrust, with the width of the slit 23 being narrower than the diameter of the central conductor 36. Further, two connector side slits 24, 24 are formed on the lower side so that the contact may be firmly retained by the elastic force of the plate shaped member 22 through the engagement with the contact of the other connector. The connector side slits 24, 24 are formed to the right and left of an extension line A, so that they may not be positioned on the extension line A in the slitting direction of the cable side slit 23. The cable side notches 25, 25 and the connector side notches 26, 26 are formed on both the right and left side of the plate shaped member 22 when the plate shaped member 22 is formed into a cylindrical shape. Thereafter, another cable side slit 23*a* and a connection side slit 24*a* are composed respectively. In the embodiment, after the socket 21 has been formed into the cylindrical shape, the connector side slits 24, 24, 24*a* are arranged at equal intervals of approximately 120 degrees, thus making it possible to have stable engagement with the contact (not shown) of the connector. The number of the cable side and connector side slits is not restricted by the above described embodiment, and a different number of slits may be provided when necessary. The number of connector side slits is preferably in the range of 1 through 5, when the mechanical strength and so on of the socket 21 is taken into consideration.

FIG. 14 shows the coaxial connector engaged with the socket 21 having the above described construction. The construction of the remainder of the connector is similar to the embodiment of the first connector shown in FIG. 9. In the embodiment of FIG. 14, the connector side 21A of the socket 21 is engaged with a male contact C of the other connector so as to firmly retain it. The cable side slits 23, 23*a* of the socket 21 grasp the central conductor 36 of the cable so as to realize a firm electrical and mechanical connection therebetween.

The socket 21 having the above described construction is larger in its mechanical strength because the cable side slit 23 and the connector side slits 24, 24 are not positioned on the same line. Furthermore, when the distance between them, namely, the distance of the cable side slit 23 from the intermediate portion between the connector side slits 24, 24 is made shorter, the socket is not required to be made longer in order to make the above described intermediate portion longer to retain the mechanical strength of the socket 21. Also, if the full length of the socket 21 is made shorter, for example, in order to make the connector smaller the mechanical strength of the socket 21 is not significantly reduced. The better electrical and mechanical connection between the central conductor 36 of the cable and the contact of the other connector may be retained.

Although a connector for a single core coaxial cable is shown in the above described embodiment, the connector of the modified embodiment of the present invention is not restricted to use with single core cable as described hereinabove, and may be used even with multiple core cable and a multiple core connector.

Figure 15A:
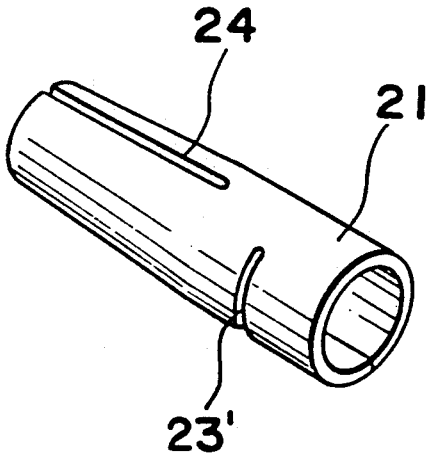
FIG. 15*a* and FIG. 15*b* are views showing another modification of the second embodiment of the invention.
Figure 15B:
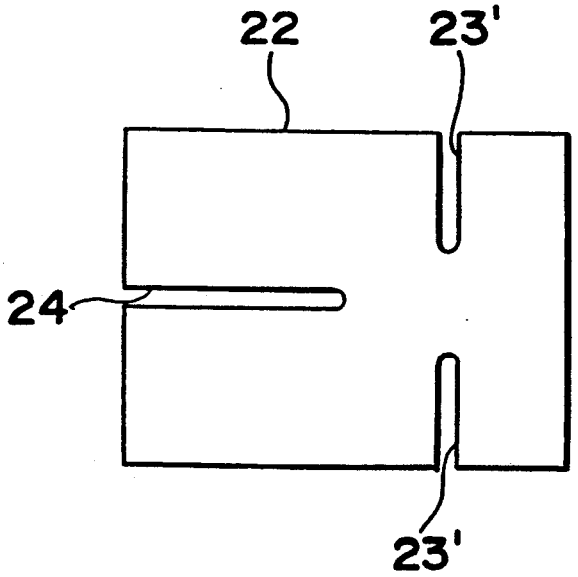

FIG. 15*a* and 15*b* show a modified socket portion (or inner contact) in accordance with the present invention. Also, as shown in FIG. 15*a* and FIG. 15*b*, even when the cable side slit 23 is formed substantially normal to the axial center of the socket 21 substantially normal to slit 24, a similar effect to the above described embodiment may be obtained.

Since the connector of the second embodiment is so constructed that the slit, which is narrower in width than the conductor of the cable, is provided in the end portion of the cylindrical socket, the conductor of the cable is thrust into the slit to cause the conductor to come into pressure contact against the socket so as to provide electrical and mechanical connection therebetween. With this arrangement, a soldering operation is unnecessary, the time of the cable assembling operation may be shortened, and disconnection of the conductor from the socket is not caused by the melting of the solder even at high temperatures. Thus, a stable connection is realized.

Since the connector in the modified embodiment of the second embodiment has the slit 23' formed in a position (i.e. normal to the slit 24) so that the slit on the connector side may not be positioned on the line extending in the same direction as the slit on the cable side, the mechanical strength is not reduced even if the socket is made smaller. Thus, a sufficient mechanical and electrical connection with the central conductor of the cable and the contact of the other connector may be retained, thereby making it possible to make the connector smaller in size.

Third Embodiment

A third embodiment of the coaxial connector in accordance with the present invention will be described hereinafter with reference to the drawings.

It is to be noted that like parts having like functions as in other embodiments are designated by like reference numerals.

Figure 16A:
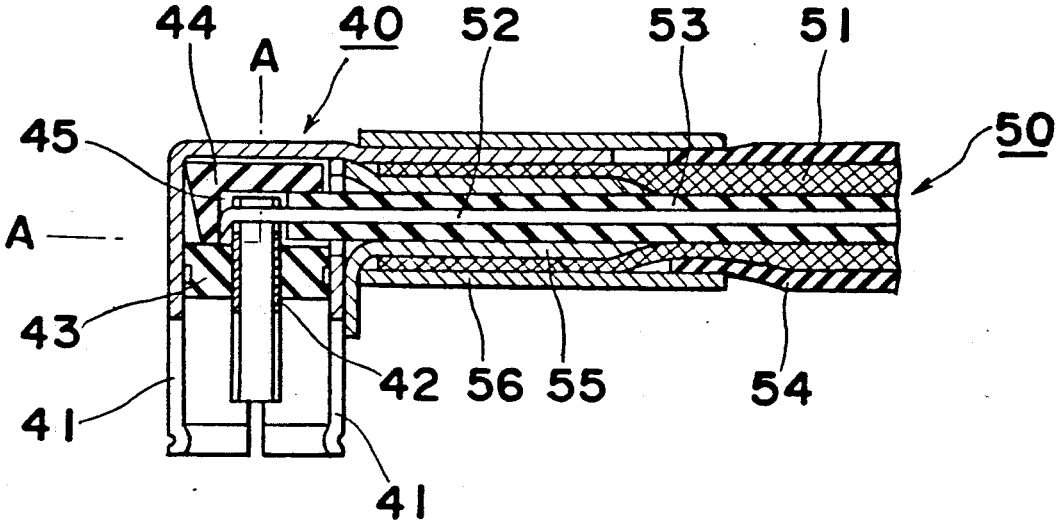
FIG. 16 (*a*) is a partial sectional view showing the coaxial connector in accordance with a third embodiment of the present invention.
Figure 16B:
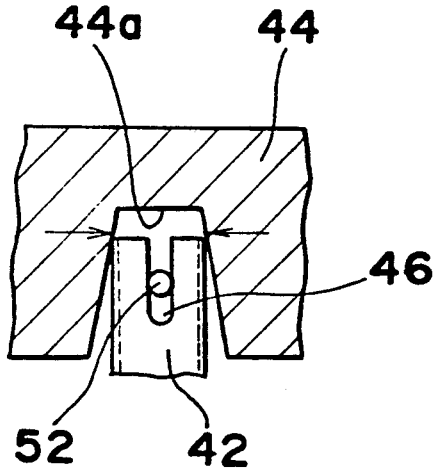

As shown in FIG. 16 (*a*), the connector central conductor 42, insulated from the connector outer conductor 41 by the insulator 43 secured into the interior of the connector outer conductor 41, is arranged within the connector outer conductor 41 of the housing 40. The connector central conductor 42 is composed of a member which has been formed into a cylindrical shape and which includes slits 46 into which the cable central conductor 52 is inserted under pressure. The slits 46 are formed in two diametrically opposite locations and are smaller in width than the cable central conductor 52.

Also, an insulating plate 44 is put on the root portion of the connector central conductor 42, and the connector central conductor 42 is retained completely insulated from the connector outer conductor 41.

An adapter 55 to be connected with the cable outer conductor 51 is mounted to the connector outer conductor 41. The cable central conductor 52 and the cable internal insulator 53 are inserted into the adapter 55, and the cable central conductor 52 is inserted under pressure into the slit 46 of the connector central conductor 42 so as to connect the connector central conductor 42 with the cable central conductor 52 electrically and mechanically.

Figure 19A:
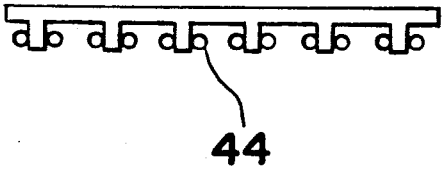
FIG. 19 (*a*) is a plan view showing one embodiment of the insulating plate molded with a hoop element.
Figure 19B:
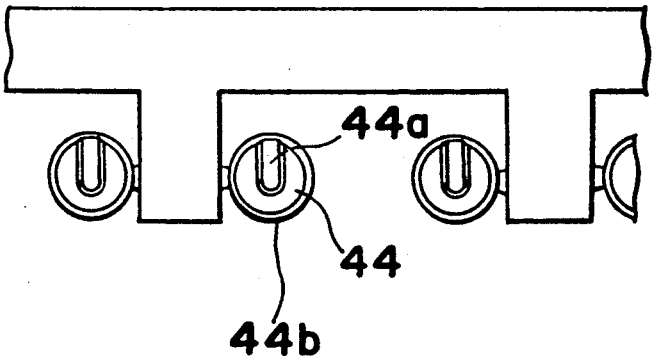
Figure 20A:
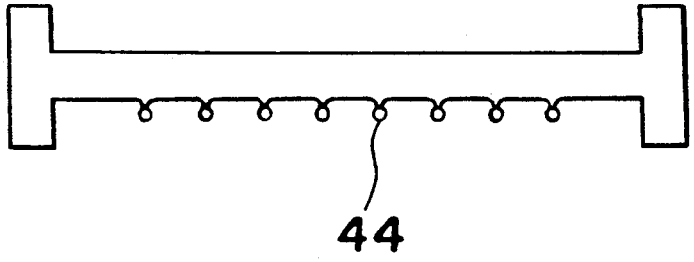
FIG. 20 (*a*) is a plan view showing another embodiment of the insulating plate molded with a hoop element.
Figure 20B:
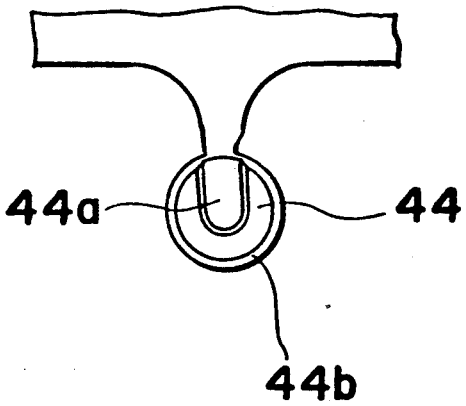

The insulating plate 44 put on the root portion of the connector central conductor 42 is formed by continuous strip molding on a hoop element (FIG. 19 and FIG. 20). When the insulating plate 44 is put on the connector central conductor 42, the proper directionality of the groove 44*a* becomes apparent when the groove 44*a* is faced downwardly. Easy adjustment of the shape of the groove 44*a* is provided especially when the continuous strip molding is utilized.

Figure 18A:
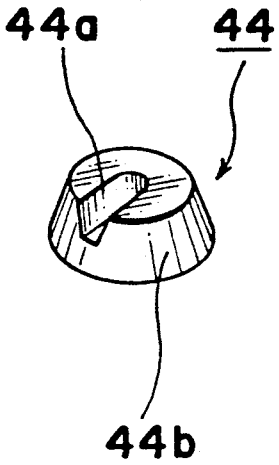
FIG. 18 (*a*) is a perspective view showing an insulating plate in accordance with the present invention.
Figure 18B:
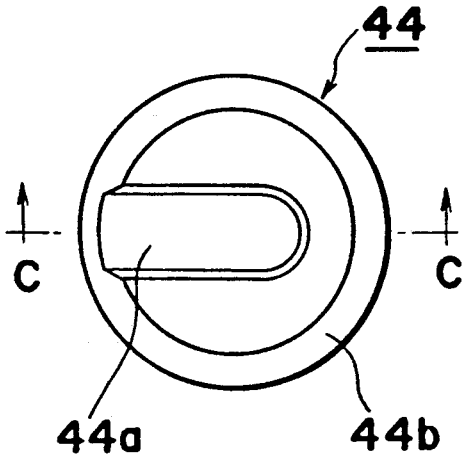
Figure 18C:
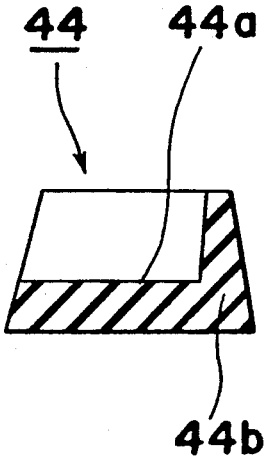

FIG. 18(*a*)–18(*c*) show an insulating plate which can be used with any connector disclosed herein. Also, as shown in FIG. 18(*a*)–18(*c*), the insulating plate 44 is formed with an upwardly and outwardly tapered shaped when positioned as in FIG. 16. Accordingly, since the outer diameter of the insulating plate 44 is smaller in its lower portion than the inner diameter of the connector outer conductor 41, the insulating plate 44 is easily inserted into the connector outer conductor 41, and may be put on the connector central conductor 42.

The groove 44*a* into which the connector central conductor 42 is inserted is formed to the outer peripheral face 44*b* from near the central portion in one face of the insulating plate 44, the groove 44*a* is tapered in a reverse direction with respect to the above described taper of the outer peripheral face 44*b*. Accordingly, as shown in FIG. 16 (*b*), when the insulating plate 44 is put on the root portion of the connector central conductor 42, the connector central conductor 42 is strictly engaged in the groove 44*a* of the insulating plate 44, so that the insulating plate 44 is not disengaged from the connector central conductor 42 by vibrations during the operation. Also, the slit 46 formed in the connector central conductor 42 is prevented from being widened by the pressure insertion of the cable central conductor 52, so that insertion of the cable central conductor 52 into the slit 46 forms a positive connection.

Figure 17A:
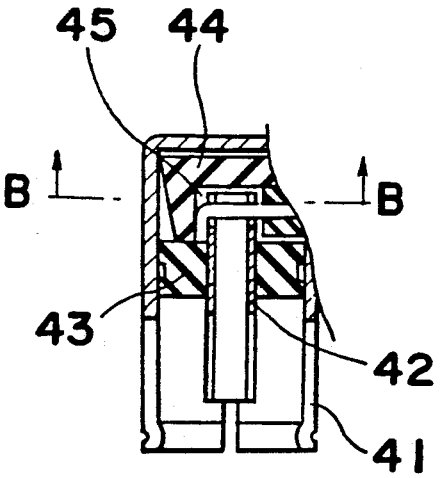
FIG. 17 (*a*) is a sectional view for illustrating a gap to be formed between the tip end face portion of a groove of an insulating plate and a connector central conductor in the embodiment of the present invention.
Figure 17B:
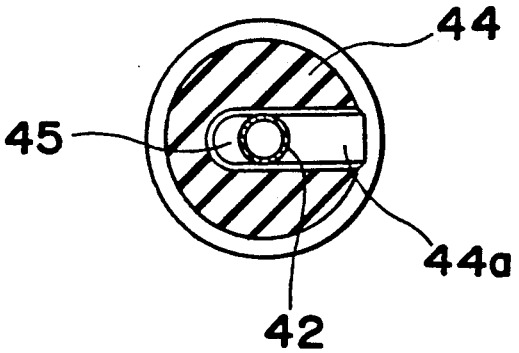

As shown in FIG. 17 (*b*), the length of the groove 44*a* is set (FIG. 17 (*b*)) so that the gap 45 may be formed between the tip end face portion of the groove 44*a* formed in the insulating plate 44 and the connector central conductor 42. Also, the thickness of the insulating plate 44 and the depth of the groove 44*a* are set so that the air gap which may be formed between the connector outer conductor 41 and the connector central conductor 42 can be prevented. Therefore, when the insulating plate 44 has been put on the connector central conductor 42, the insulating plate 44 sufficiently covers the root portion of the connector central conductor 42, and the excess length of the cable central conductor 52 and protrudes from the connector central conductor 42 is accommodated within the gap 45. Thus, short-circuiting of the cable central conductor 52 with the connector external conductor 41 is prevented. Therefore, the connection can withstand a higher voltage.

In the coaxial connector of the third embodiment as described hereinabove, the insulating plate to be put on the root portion of the connector central conductor is formed by molding on a hoop element, the outer peripheral face thereof is upwardly and outwardly tapered, the groove into which the above described connector central conductor is inserted is formed in the central portion thereof, and the groove is formed with a taper reverse to the above described taper. Also, since the length of the above described groove is set so that the gap may be formed between the tip end face portion of the above described groove and the above described connector central conductor, the directionality of the groove becomes apparent even if the groove face is provided downwardly when the above described insulating plate is put on the above described connector central conductor. Especially when the continuous strip molding operation is effected by molding with use of the hoop element the groove shape becomes easy to effect. Also, since the outer diameter of the insulating plate lower portion is smaller than the inner diameter of the connector outer conductor, the above described insulating plate may be inserted into the above described connector outer conductor, and the above described groove tapers downwardly and outwardly, so that the above described insulator may be easily put on the above described connector central conductor, thus improving the operation thereof. Furthermore, the above described connector central conductor is strictly engaged into the groove of the above described insulating plate so as to prevent the above described insulating plate from being disengaged from the above described connector central conductor by vibrations and the like during operation thereof. Also, this tapering of the groove prevents the slit formed in the above described connector central conductor from being widened by pressure insertion of the above described cable central conductor, so that a positive connection is maintained between the above described connector central conductor and the cable central conductor may be made positive. Further, as the excess length of the cable central conductor is accommodated by the above described groove of the above described insulation plate, short-circuiting may be prevented, thus increasing the voltage which the connection can withstand.

Fourth Embodiment

A fourth embodiment of the coaxial connector will be described hereinafter with reference to the drawings.

Figure 21:
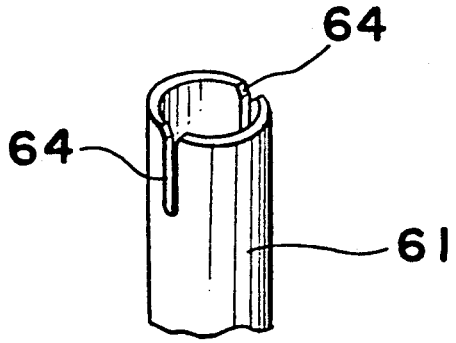
FIG. 21 is a perspective view showing the essential portions of a central conductor of a coaxial connector in accordance with a fourth embodiment of the invention.

As illustrated in FIG. 21, the connector central conductor 61 is composed of a member formed into a cylindrical shape with a slit 64 into which the cable central conductor 71 is inserted under pressure. The slit 64 is formed at two diametrically opposed locations and is smaller in width than the cable central conductor 71.

Figure 22:
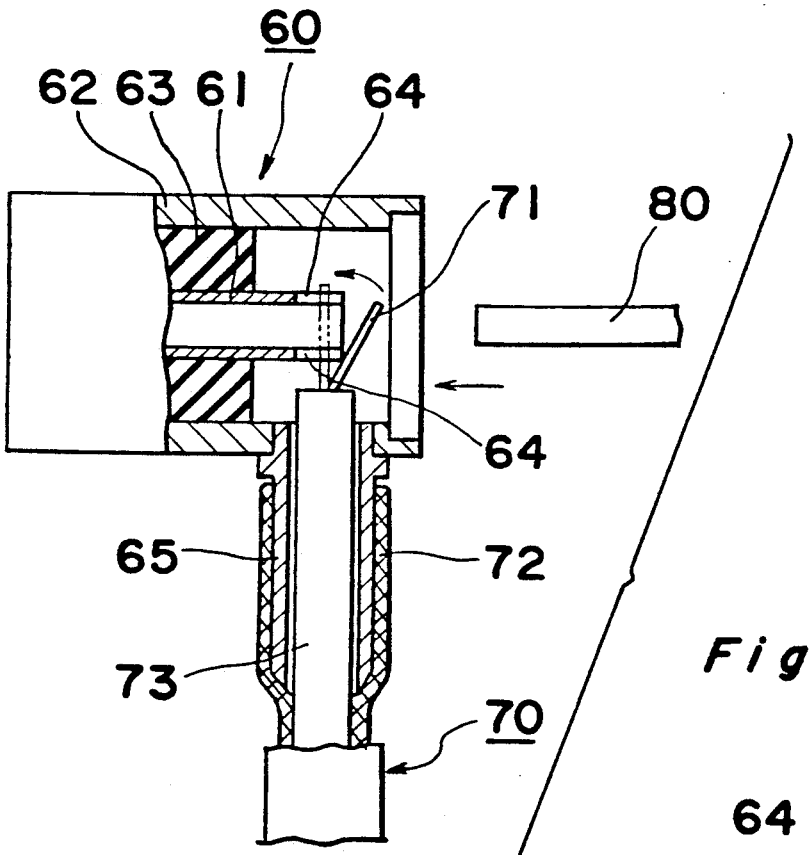
FIG. 22 is a partial sectional view showing the connector having an inner contact in accordance with the fourth embodiment.
Figure 23:
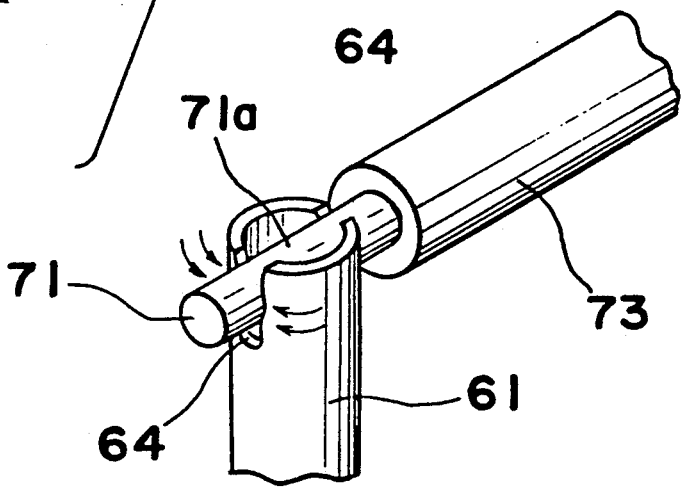
FIG. 23 is a perspective view showing the essential portions of the fourth embodiment of the connecting construction in accordance with the present invention.

The coaxial connector having the above described connector central conductor 61 will be described hereinafter with reference to FIG. 22. The cylindrical connector central conductor 61 shown in FIG. 21 which is insulated from the connector outer conductor 62 by the connector internal insulator 63 is disposed within the connector outer conductor 62 of the housing 60. The outer conductor adapter 65 to be connected with the outer conductor 72 of the cable is mounted on the connector outer conductor 62. The cable central conductor 71 and the cable internal insulator 73 are inserted into the outer conductor adapter 65, and the cable central conductor 71 is inserted into the slit 64 of the connector central conductor 61. The depressing jig 80 is inserted through the opening portion of the housing 60, and the cable central conductor 71 is inserted under pressure (in the direction of an arrow in FIG. 22) into the slit 64 of the connector central conductor 61 is strictly connected with the cable central conductor 71 electrically and mechanically (FIG. 23). On the other hand, auxiliary soldering 71*a* can be applied on the surface of the cable central conductor 71 to be inserted under pressure into the connector central conductor 61. The auxiliary welding method is not restricted to the plating shown in FIG. 24(*a*) and 25(*a*).

Figure 24A:
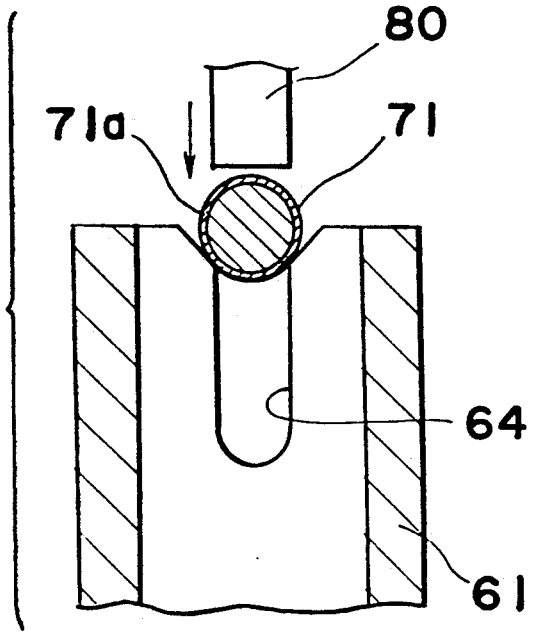
FIG. 24 (*a*) is a plan sectional view showing a condition before a cable central conductor is inserted under pressure into the slit of the connector central conductor.
Figure 24B:
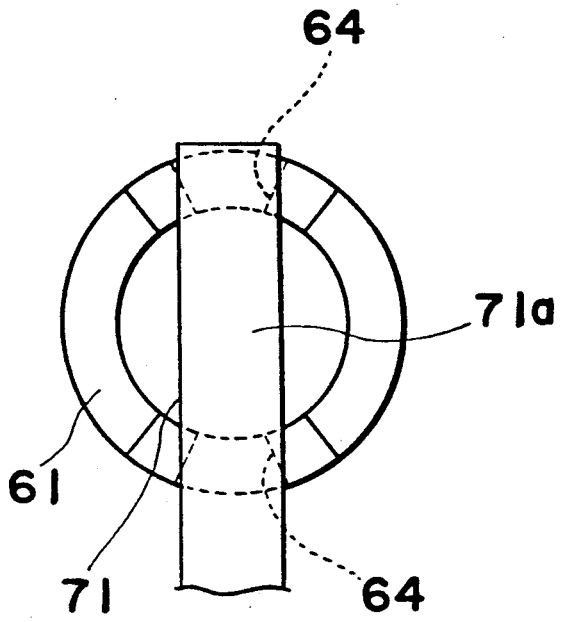
Figure 25A:
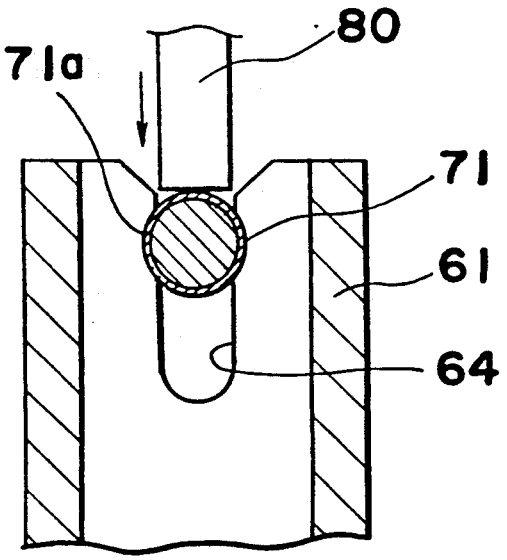
FIG. 25 (*a*) is a plan sectional view showing a condition after the cable central conductor has been inserted under pressure into the slit of the connector central conductor.
Figure 25B:
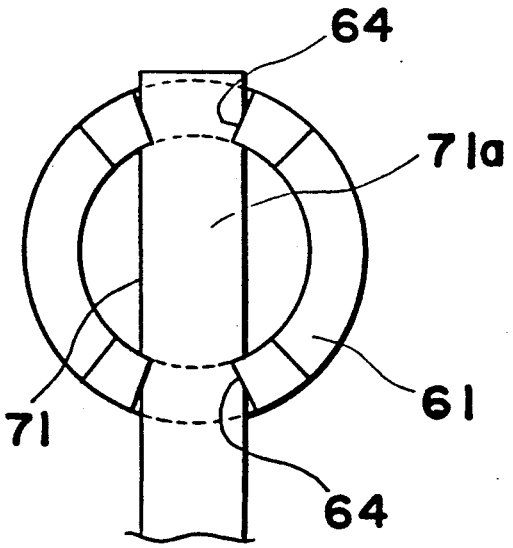
Figure 26:
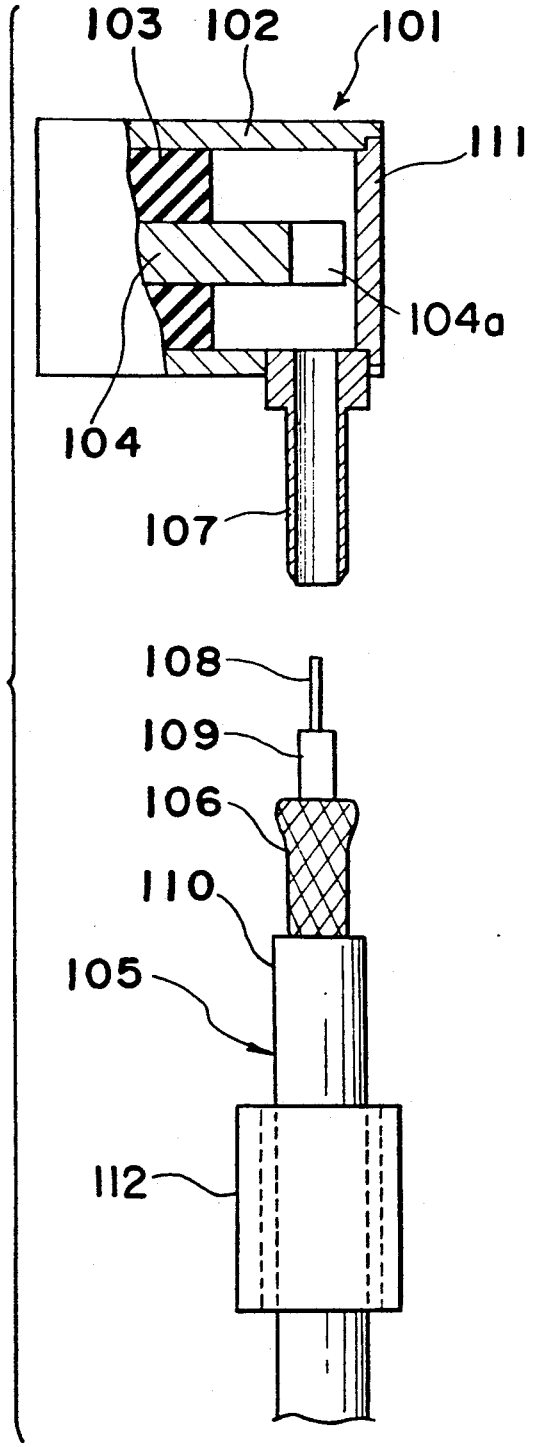
Fig. 26 Prior Art
FIG. 26 and FIG. 27 are partial sectional views showing a conventional connector.
Figure 27:
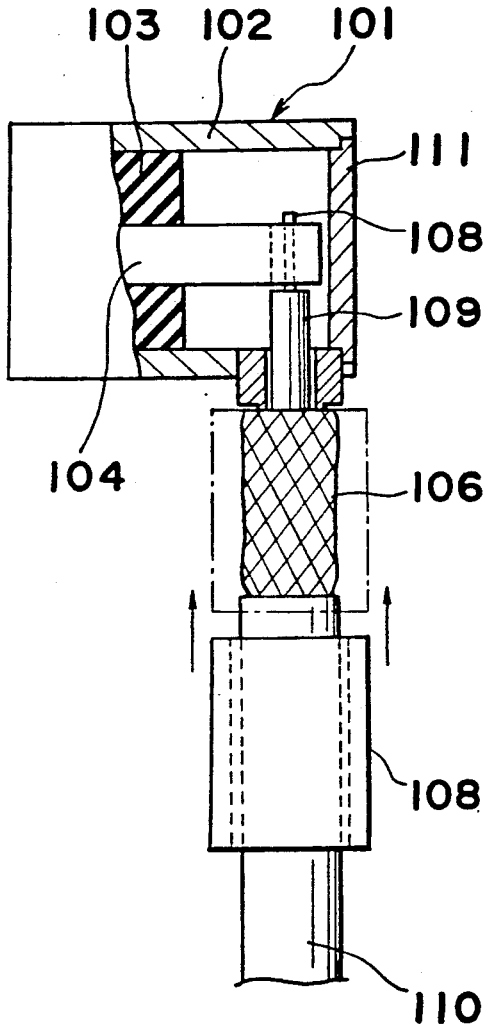
Fig. 27 Prior Art

A condition prior to the cable central conductor 71 being auxiliarily soldered and inserted under pressure into the slit 64 of the connector central conductor 61 is shown in FIG. 24(*a*) and (*b*), and a condition after the central conductor 71 has been inserted under pressure is shown in FIG. 25 (*a*) and (*b*).

In the construction as described, the step of soldering between the connector central conductor 61 and the cable central 71 is not necessary. Therefore, easier mechanization may be effected, the operation time may be shortened, and the connection is made positive, thus resulting in reliable quality. Since the solder is not melted due to connection between the connector central conductor 61 and the cable central conductor 71 even at high temperatures, a reliable connection may be retained. Also, as described in the case of the above described embodiment, when the cable central conductor 71 is brought into pressure contact at two locations of the connector central conductor 61, the mounting strength is increased more than if there was pressure contact at only one location. Thus, the electrical connection is reliable. Further, as the auxiliary soldering 71*a* is applied upon the cable central conductor 71, an increase in the contact resistance due to oxidation of the cable central conductor 71 may be prevented, and the quality may be improved.

Although the present invention has been fully described by way of example with reference to the accompanying drawings, it is to be noted here that various changes and modification will be apparent to those skilled in the art. Therefore, unless such changes and modification otherwise depart from the scope of the present invention, they should be construed as included therein.

What is claimed is:

1. A connector adapted to be mounted to a coaxial cable having a cable internal conductor, an internal insulator surrounding the internal conductor, a shield conductor surrounding the internal insulator, and a cable outer insulator surrounding the shield conductor, said connector comprising:

a housing comprising, an outer conductor having a main portion with a front end and a rear end, and an inner contact mounted within said main portion of said outer conductor and being adapted to be connected to the internal conductor of the coaxial cable;

an outer conductor adapter which is one piece with, in electrical contact with, and extending away from said main portion of said outer conductor of said housing, said outer conductor adapter being adapted for insertion between the cable internal insulator and the shield conductor of the coaxial cable; and a sleeve portion formed as one piece with, in electrical contact with, and extending away from said outer conductor of said housing, at least part of said sleeve portion being adapted to wrap around the coaxial cable so as to cause the shield conductor of the coaxial cable to adhere under pressure to said outer conductor adaptor.

2. A connector as recited in claim 1, further comprising means for mounting said inner contact within said main portion of said outer conductor and for electrically insulating said inner contact from said main portion of said outer conductor.

3. A connector as recited in claim 2, wherein:

said main portion of said outer conductor and said inner contact are substantially cylindrical; and said inner contact is mounted substantially concentrically within said main portion of said outer conductor.

4. A connector as recited in claim 1, wherein said at least part of said sleeve portion which is adapted to wrap around the coaxial cable comprising a single securing member adapted to wrap around the outer insulator of the coaxial cable.

5. A connector as recited in claim 1, wherein said at least part of said sleeve portion which is adapted to wrap around the coaxial cable comprises a first securing member adapted to wrap around the shield conductor of the coaxial cable, and a second securing member adapted to wrap around the outer insulator of the coaxial cable, said first and second securing members being separated by slots.

6. A connected as recited in claim 5, wherein said second securing member is spaced further from said main portion of said outer conductor than said first securing member is spaced from said main portion of said outer conductor.

7. A connector as recited in claim 1, wherein said inner contact includes means for engaging the internal conductor of the coaxial cable.

8. A connector as recited in claim 7, wherein said engaging means comprises a pair of diametrically opposed elongated slots formed in said inner contact longitudinally along said inner contact adjacent a rear end thereof, said pair of slots being adapted to be narrower in width than a diameter of the internal conductor of the coaxial cable such that the internal conductor can be thrust into said pair of slots from said rear end of said inner contact to provide a positive electrical and mechanical connection between the internal conductor and said inner contact.

9. A connector as recited in claim 7, wherein said engaging means comprises a slot formed in said inner contact about a portion of the circumference of said inner contact near a rear end thereof, said slot being adapted to be narrower in width than a diameter of the internal conductor of the coaxial cable such that the internal conductor can be thrust into said slot to provide a positive electrical and mechanical connection between the internal conductor and said inner contact.

10. A connector as recited in claim 7, wherein said inner contact further includes means for firmly holding a mating contact of a cable to be connected to the coaxial cable.

11. A connector as recited in claim 10, wherein said firm holding means comprises at least one elongated slit formed longitudinally along said inner contact adjacent a forward end thereof.

12. A connector as recited in claim 11, wherein said at least one elongated slit comprises a plurality of elongated slits spaced evenly about the circumference of said inner contact.

13. A connector as recited in claim 1, wherein said outer conductor of said housing further includes a rear cover portion which, when said at least part of said sleeve portion is wrapped around the coaxial cable, substantially closes said rear end of said main portion of said outer conductor.

14. A connector as recited in claim 13, further comprising means for insulating said inner contact from said rear cover portion of said outer conductor and for compressing a rear end of said inner contact radially inwardly.

15. A connector as recited in claim 14, wherein said inner contact includes means for engaging the internal conductor of the coaxial cable; and said engaging means comprises a pair of diametrically opposed elongated slots formed longitudinally along said inner contact adjacent a rear end thereof.

16. A connector as recited in claim 15, wherein said insulating means comprises a substantially frustoconically shaped insulating member having a front end and a rear end, said front end being smaller in diameter than said rear end.

17. A connector as recited in claim 16, wherein said insulating member has a groove formed in a front face thereof along a diametric line from a central portion of said front face to a peripheral edge thereof, said groove having sidewalls tapered from front to back with a forwardmost portion of said groove being wider than a rearwardmost portion thereof; and said groove is adapted to receive said rear end of said inner contact.

18. A connector as recited in claim 1, further comprising means for positively securing the internal conductor of the coaxial cable to a rear end of said inner contact upon heating and subsequent cooling.

19. A connector as recited in claim 18, wherein said securing means comprises solder formed about the internal conductor of the coaxial cable.

20. A connector adapted to be mounted to a coaxial cable having a cable internal conductor, an internal insulator surrounding the internal conductor, a shield conductor surrounding the internal insulator, and cable outer insulator surrounding the conductor, said connector comprising:

a housing comprising, an outer conductor having a main portion with a front end and a rear end, and an inner contact mounted within said main portion of said outer conductor and being adapted to be connected to the internal conductor of the coaxial cable;

an outer conductor adapter fixed to, in electrical contact with, and extending away from said main portion of said outer conductor of said housing, said outer conductor adapter being adapted for insertion between the cable internal insulator and the shield conductor of the coaxial cable; and a sleeve portion formed as one piece with, in electrical contact with, and extending away from said outer conductor of said housing, at least part of said sleeve portion being adapted to wrap around the coaxial cable so as to cause the shield conductor of the coaxial cable to adhere under pressure to said outer conductor adaptor; and wherein said outer conductor of said housing further includes a rear cover portion which, when said at least part of said sleeve portion is wrapped around the coaxial cable, substantially closes said rear end of said main portion of said outer conductor.

21. A connected as recited in claim 20, further comprising means for mounting said inner contact within said main portion of said outer conductor and for electrically insulating said inner contact from said main portion of said outer conductor.

22. A connector as recited in claim 21, wherein said main portion of said outer conductor and said inner contact are substantially cylindrical; and said inner contact is mounted substantially concentrically within said main portion of said outer conductor.

23. A connector as recited in claim 22, wherein said at least part of said sleeve portion which is adapted to wrap around the coaxial cable comprises a first securing member adapted to wrap around the shield conductor of the coaxial cable, and a second securing member adapted to wrap around the outer insulator of the coaxial cable.

24. A connector as recited in claim 23, wherein said second securing member is spaced further from said main portion of said outer conductor than said first securing member is spaced from said main portion of said outer conductor.

25. A connector as recited in claim 24, wherein said inner contact includes means for engaging the internal conductor of the coaxial cable.

26. A connector as recited in claim 25, wherein said engaging means comprises a pair of diametrically opposed elongated slots formed in said inner contact longitudinally along said inner contact adjacent a rear end thereof, said pair of slots being adapted to be narrower in width than a diameter of the internal conductor of the coaxial cable such that the internal conductor can be thrust into said pair of slots from said rear end of said inner contact to provide a positive electrical and mechanical connection between the internal conductor and said inner contact.

27. A connector as recited in claim 25, wherein said engaging means comprises a slot formed in said inner contact about a portion of the circumference of said inner contact near a rear end thereof, said slot being adapted to be narrower in width than a diameter of the internal conductor of the coaxial cable such that the internal conductor can be thrust into said slot to provide a positive electrical and mechanical connection between the internal conductor and said inner contact.

28. A connector as recited in claim 25, wherein said inner contact further includes means for firmly holding a mating contact of a cable to be connected to the coaxial cable.

29. A connector as recited in claim 28, wherein said firm holding means comprises at least one elongated slit formed longitudinally along said inner contact adjacent a forward end thereof.

30. A connector as recited in claim 29, wherein said at least one elongated slit comprises a plurality of elongated slits spaced evenly about the circumference of said inner contact.

31. A connector as recited in claim 20, further comprising means for insulating said inner contact from said rear cover portion of said outer conductor and for compressing a rear end of said inner contact radially inwardly.

32. A connector as recited in claim 31, wherein said inner contact includes means for engaging the internal conductor of the coaxial cable; and said engaging means comprises a pair of diametrically opposed elongated slots formed longitudinally along said inner contact adjacent a rear end thereof.

33. A connector as recited in claim 32, wherein said insulating means comprises a substantially frustoconically shaped insulating member having a front end and a rear end, said front end being smaller in diameter than said rear end.

34. A connector as recited in claim 33, wherein said insulating member has a groove formed in a front face thereof along a diametric line from a central portion of said front face to a peripheral edge thereof, said groove having sidewalls tapered from front to back with a forwardmost portion of said groove being wider than a rearwardmost portion thereof; and said groove is adapted to receive said rear end of said inner contact.

* * * * *